US006065544A

United States Patent [19]

Holbert

[11] Patent Number: 6,065,544

[45] Date of Patent: May 23, 2000

[54] METHOD AND APPARATUS FOR MULTIPLE PACKER PRESSURE RELIEF

[76] Inventor: Marvin L. Holbert, #40 Glenview Cresent, Cochrane, Canada, T0L 0W3

[21] Appl. No.: 09/043,764

[22] PCT Filed: Feb. 10, 1997

[86] PCT No.: PCT/CA97/00092

§ 371 Date: Mar. 26, 1998

§ 102(e) Date: Mar. 26, 1998

[87] PCT Pub. No.: WO97/30266

PCT Pub. Date: Aug. 21, 1997

[30] Foreign Application Priority Data

Feb. 13, 1996 [CA] Canada ..... 2169382

[51] Int. Cl.[7] ..... E21B 33/12

[52] U.S. Cl. ..... 166/387; 166/127; 166/142; 166/147; 166/186; 166/187; 166/191

[58] Field of Search ..... 166/127, 147, 166/186, 191, 187, 387, 142

[56] References Cited

U.S. PATENT DOCUMENTS

| | | | |
|---|---|---|---|
| 2,741,313 | 4/1956 | Bagnell | 166/147 |
| 2,959,225 | 11/1960 | Roberts | 166/147 |
| 3,500,911 | 3/1970 | Farley et al. | 166/250 |
| 3,799,260 | 3/1974 | Barrington | 166/185 |
| 3,876,003 | 4/1975 | Kisling | 166/250 |
| 4,577,696 | 3/1986 | Suman | 166/387 |
| 4,586,526 | 5/1986 | Reardon | 137/70 |
| 4,648,448 | 3/1987 | Sanford et al. | 166/191 |
| 4,749,037 | 6/1988 | Christensen | 166/184 |
| 4,877,086 | 10/1989 | Zunkel | 166/106 |
| 5,101,908 | 4/1992 | Mody | 166/387 |
| 5,549,165 | 8/1996 | Brooks | 166/386 |

*Primary Examiner*—Eileen Dunn Lillis
*Assistant Examiner*—John Kreck
*Attorney, Agent, or Firm*—Miles & Stockbridge P.C.; John C. Kerins

[57] ABSTRACT

A system for relieving pressurized fluid entrapped in a annular space between a casing (12) and the surrounding wall (11) of a well bore hole (10) during deployment of a packer exterior (14) of the casing (12) for sealing engagement with the wall (11). When packer (14) is inflated in a zone (17) where fluid is entrapped, such as an intermediate packer between two previously inflated packers (13, 14), the squeeze pressure developed by the inflating packer (14) has been found to be sufficient to prevent effective and lasting sealing of the intermediate packer (14). The present system includes a valve mechanism (35) which is activated by the pressurized fluid providing for inflating the packer (14) to open a passageway (90, 94, 91) to bleed the entrapped fluid into the casing (12) and to then close the passageway (90, 94, 91) as inflation of the intermediate packer (14) is completed.

16 Claims, 11 Drawing Sheets

METHOD AND APPARATUS FOR MULTIPLE PACKER PRESSURE RELIEF

TECHNICAL FIELD

This invention relates to a method and a system for use in activating an inflatable packer about a casing for sealing engagement with the wall of a bore hole, and more particularly, to a method and system for effectively inflating a packer in a zone defined between a pair of previously expanded packers by simultaneously relieving entrapped fluid pressure from the zone.

A packer is utilized in conjunction with a casing installed in a bore hole so that on expansion of the packer, it engages the wall of the bore to prevent the flow of fluid and material carried by the fluid along the annular space between the casing and wall of the bore hole. The packer also resists any axial shifting of the casing within the bore as the well is being operated. It is common to use at least two axially spaced packers to isolate a length of the axial space between the casing and the wall of the bore hole so that, for example, water being produced from a particular zone or earth formation is not allowed to flow either upwardly or downwardly so as to thereby mix with other fluid being pumped from the borehole and up the casing.

A common type of packer now used includes a sleeve of resilient material which surrounds the casing and is closed at opposite ends so that as a pressurized fluid is pumped into the casing and through a valve into the space between the resilient sleeve and the casing, the resilient sleeve inflates to the extent it tightly engages the wall of the bore and thereby deploys as a seal of the annulus between the casing and the bore wall. When sufficient pressure is achieved to ensure an effective seal, the valve closes to hold the pressurized fluid in the inflated packer so as to maintain it in its initially inflated condition.

The casing in the well may be provided with a pair of like separate inflatable packers which are axially spaced along the casing and when both of the pair of packers are inflated, the fluid in the annular space between the pair is entrapped. This entrapped fluid, for example, may be water which is being produced at a particular level or zone of the well and spaced from another zone of interest. It is not uncommon, however, to provide additional packers in the string which are not inflated initially with the first pair. Eventually, it may become desirable to inflate an additional packer located between the already inflated pair. It has been found that due to the pressure of the fluid between the already inflated pair, and which pressure may in fact increase as the inflation of the additional packer commences, the pressure of this entrapped fluid can become sufficient to prevent the proper inflation of the additional packer. Moreover, as this high fluid pressure, called the squeeze pressure, bleeds off either into the formation forming the wall of the bore, or even past the previously inflated pair of packers, the sealing effort of the newly inflated packer may become ineffective.

DISCLOSURE OF INVENTION

It is an object of the present invention to provide a squeeze relief valve, which is relatively inexpensive and which functions on inflation of an associated inflatable packer to provide a relief of the pressure of the fluid in the annular space about the casing in the vicinity of the packer.

It is also an object of the present invention to provide a method of achieving automatic bleeding of the annular space in the vicinity of a packer means during the inflation of such packer means.

According to one aspect of the present invention there is provided a relief valve system for use in a casing positioned in a well bore wherein the valve system provides a relief of entrapped pressurized fluid in an annular space between an exterior surface of the casing member during expansion of an associated inflatable packer means provided on the exterior surface of the casing member. The system allows effective sealing of the packer means against the wall of the well bore. The packer means is of the type having packer valve means for permitting the flow into the packer means of inflating fluid transferred to the packer means at pressures controlled from ground surface. The packer valve means is responsive to an increasing pressure of the inflatable fluid to open and allow flow of the inflating fluid to the interior of the packer means. The relief valve system of the present invention includes a housing defining an inlet in fluid communication with the annular space and an outlet in fluid communication with an interior of the casing. Means defines a passage placing the inflating fluid in communication with a valve control chamber in the housing. A valve member is disposed in the housing, and in an initial position closes fluid communication between the inlet and outlet, the valve member being moveable to an open position in response to the inflating fluid in the control chamber reaching a predetermined pressure so that fluid flow is permitted from the inlet to the outlet of the housing. The valve member is moveable to a closed position in response to the inflating fluid in a control chamber reaching a second predetermined pressure to thereby close the fluid communication between the fluid inlet and outlet of said housing.

According to another aspect of the invention there is provided a method of inflating a packer means disposed about a casing in an annular space between an exterior of the casing and a wall of a well bore containing the casing. The packer means is of the type having valve means responsive to an increase in fluid pressure supplied thereto for admitting the pressurized fluid to an interior of the packer means to thereby deploy the packer means. The method of the present invention includes a step of providing the casing prior to insertion of the casing into the bore with a relief valve means in the vicinity of the packer means, the relief valve means having inlet means in fluid communication with the annular space and an outlet means in fluid communication with an interior of the casing, the relief valve means also including an actuating means responsive to a first predetermined pressure of the supply fluid of the packer means for placing the inlet means in fluid communication with the outlet means, the actuating means being further responsive to a second predetermined pressure for closing the communication between the inlet means and the outlet means. The method also includes the step of supplying a fluid at the first predetermined pressure to the packer means for initially deploying the packer means whereby the actuating means of the relief valve means places the inlet means in communication with the outlet means so as to allow bleeding of fluid from within the annular space to the interior of a casing during inflation of the packer means. The method further includes a step of varying the pressure of the fluid supplied to the packer means to the second predetermined pressure during the termination of the deployment of the packer means so that the actuating means of the relief valve means closes communication between the annular space and the interior of the casing.

BRIEF DESCRIPTION OF THE DRAWINGS

In the accompanying drawings, which include illustrations of embodiments of the present invention.

BEST MODE FOR CARRYING OUT THE INVENTION

Figure 1A:
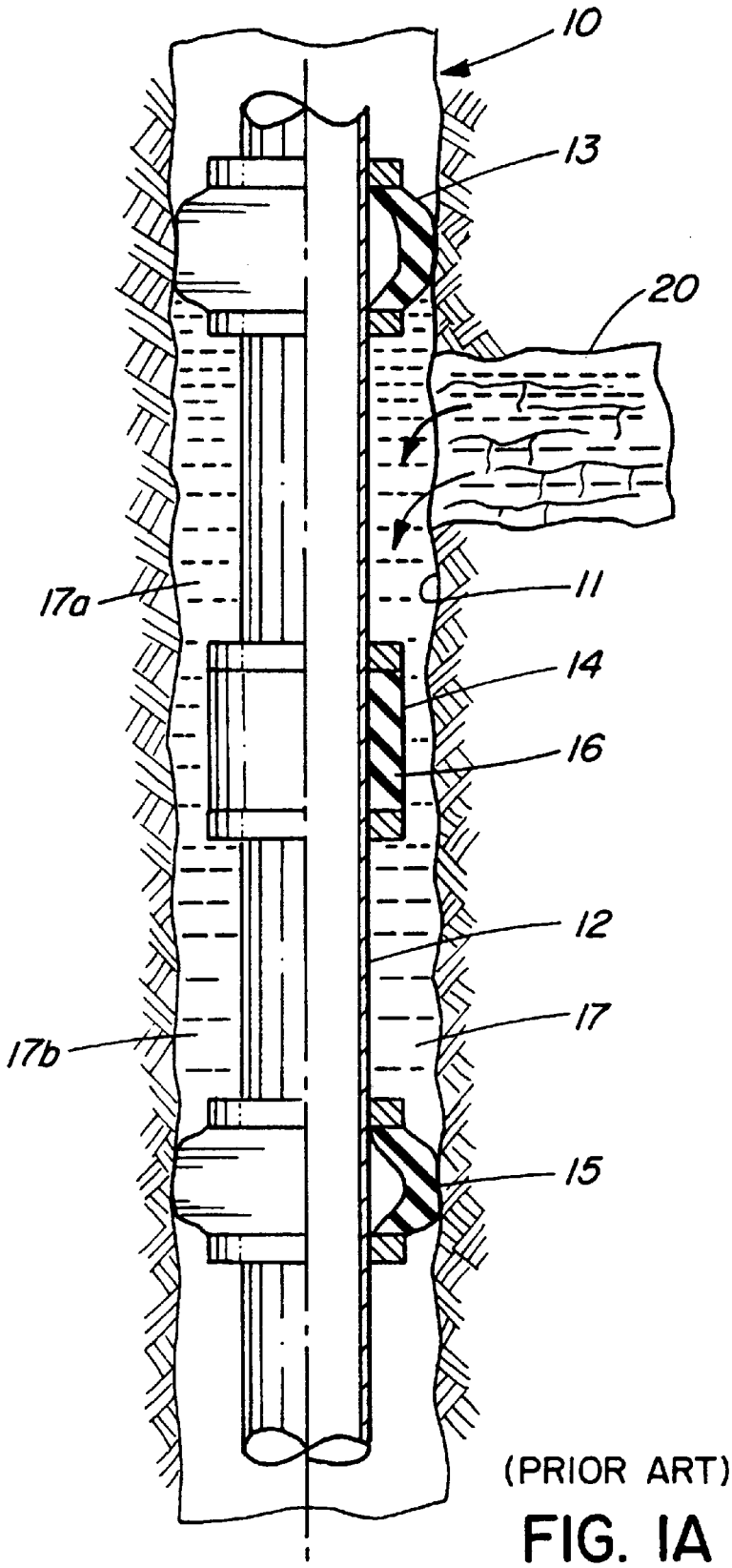
(PRIOR ART) FIG. 1A
FIG. 1A, 1B & 1C show the manner in which inflated packers are used in the bore hole of a well and in FIGS. 1B and 1C there is demonstrated the effects of inflation of an additional packer between two already inflated packers.

In FIG. 1A there is shown a bore hole 10 defined by a wall 11 of a drilled well bore and into which has been inserted a casing 12. The casing 12 which is in the form of a metal tubular member is of smaller diameter than the bore hole so that there exists an annular space between the casing 12 and the wall 11 of the bore hole. The casing 12 as inserted into the bore hole includes longitudinally spaced packers 13, 14 and 15 which are of the inflatable type. Prior to inflation, as shown in the case of packer 14, the packer consists of an elongated resilient tubular member 16 which closely surrounds the casing. As shown in FIG. 1A, the uppermost packer 13 and the lowermost packer 15 are inflated so as to tightly engage the wall 11. Due to their resilient nature the outer surfaces of the resilient tubular member are capable of tightly sealing against the irregular surface or wall 11 of the bore hole particularly found in an open or drilled hole. Thus, in the arrangement shown in FIG. 1A, the portion 17 of the annular space between the pair of inflated packers 13 and 15 is isolated from the remainder of the annular space between the wall 11 and the outer surface of the casing 12.

Figure 1B:
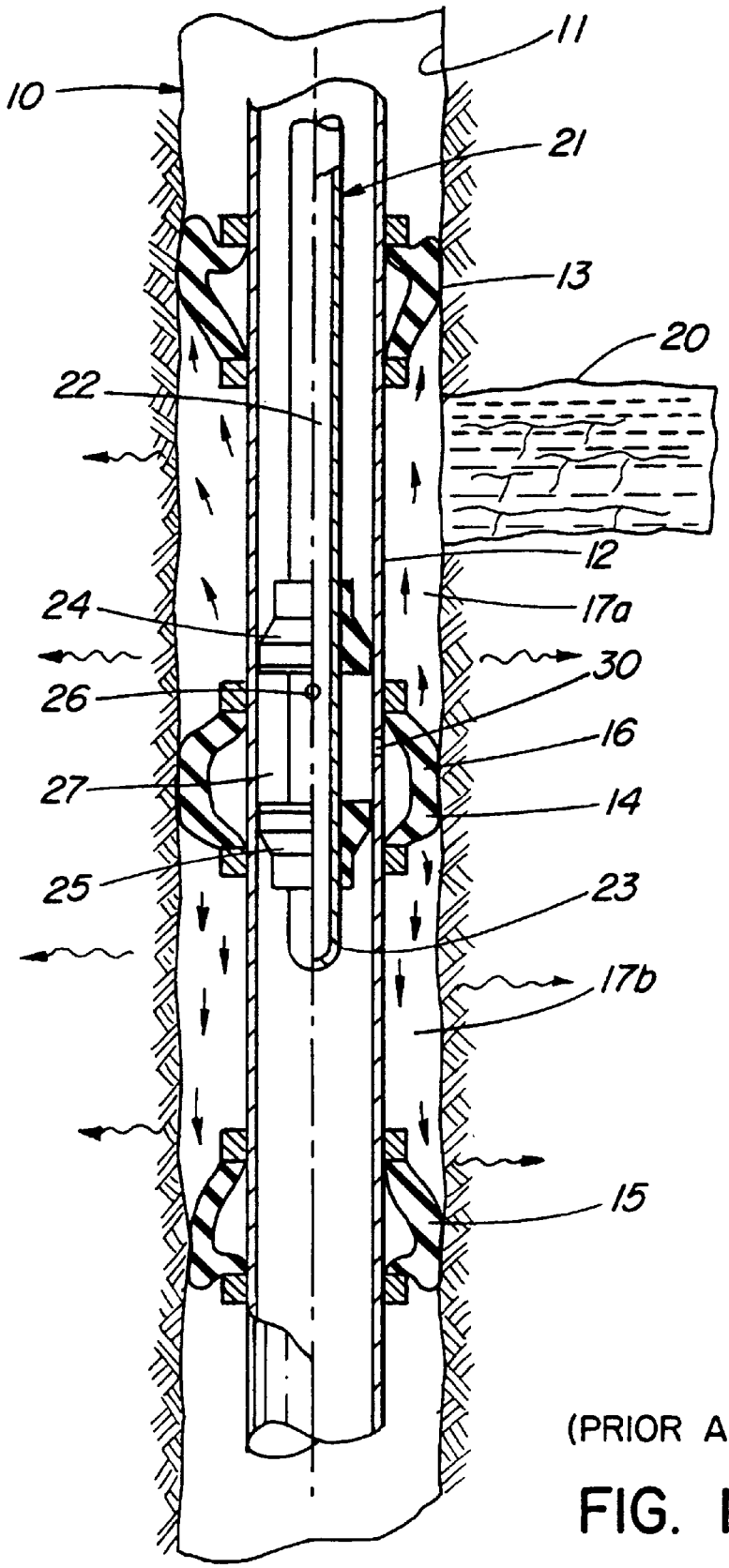
(PRIOR ART) FIG. 1B

In the event it becomes apparent that the upper portion 17*a* of the overall isolated portion 17 between already inflated packers 13 and 15 should be blocked off from the lower portion 17*b*, such as if it becomes apparent a zone 20 of the earth structure surrounding the bore hole is developing into a water producing zone, packer 14 is deployed (FIG. 1B). This involves inserting a tool 21 into the casing 12. The tool 21 includes a tubular member 22 which has an external diameter which is smaller than the internal diameter of the casing 12. The lower end 23 of the tubular member 22 is closed, and the tubular member 22 carries a pair of packer cups, i.e. upper packer cup 24 and lower packer cup 25. The lower packer cup 25, which is affixed to the exterior of the tubular member 22, opens upwardly, and the upper packer cup 24, which is also affixed to the tubular member, opens downwardly so that as pressurized fluid is applied to the interior member 22 at the well head, the fluid exits through a port 26 positioned in tubular member 22 between the packer cups causing the packer cups 24 and 25 to be forced against the interior of the casing 10 to thereby seal a zone 27 within the casing. As the pressure of the fluid inserted into the zone 27 increases, a valve 30 associated with the packer 14 allows flow to the interior of the packer. The valve 30, which is not shown in detail, is of the type which opens, when subjected to a predetermined pressure and allows the pressurized fluid to flow from zone 27 to the interior of the resilient tubular member 16. When the expansion of the inflatable packer 14 is complete, the valve 30 moves to a position to close the valve and thus maintain the pressurized fluid within the packer.

Still referring to FIG. 1B, it will be appreciated that prior to inflation of the packer 14, fluid is entrapped in the isolated portion or zone 17 of the annular space. As the inflation of packer 14 commences due to the flow of pressurized fluid to the interior of the packer, the entrapped fluid in zone 17, which becomes divided into upper zone 17*a* and lower zone 17*b*, is further pressurized. This is due to the fact the already inflated packers 13 and 15 block the flow of fluid from the isolate zone 17, and thus, there is established what is termed a squeeze pressure due to the expansion of packer 14. As illustrated in FIG. 1B this may cause a distortion in the sealing of the already inflated packers 13 and 15, but of more importance, the increased pressure in the isolated zone 17 usually results in an incomplete and ineffective sealing of the packer 14.

Figure 1C:
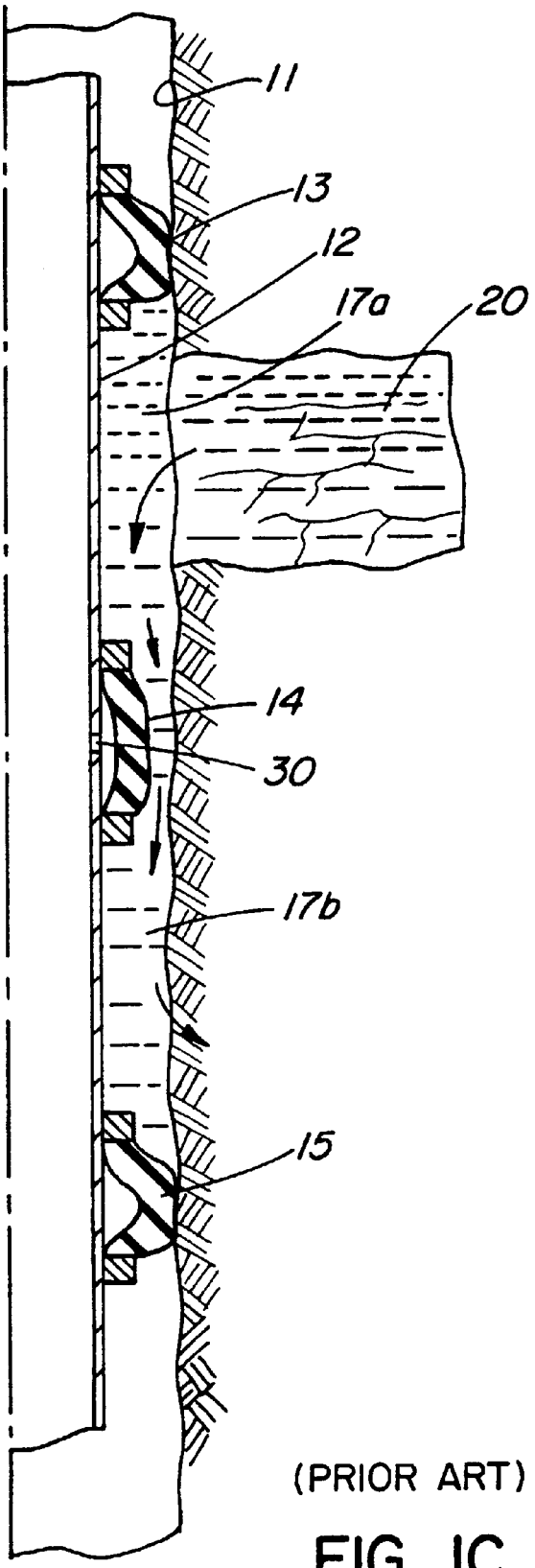
(PRIOR ART) FIG. 1C

Subsequent to the inflation of packer 14 under the above described condition, the increase pressure caused by the initial inflation of the packer 14 causes fluid to bleed off or dissipate into the surrounding earth formation. Such bleed off may be to the extent that recently inflated packer 14 can lose its sealing contact with the wall of the bore hole (FIG. 1*c*). This results, of course in the unwanted flow of well fluids past the packer 14. For the situation described as an example in relation to FIG. 1A, the flow of water from the zone 20 into the upper annular space 17*a*, can resume its flow into the lower annular space 17*b* as before the inflation of packer 14.

Figure 2A:
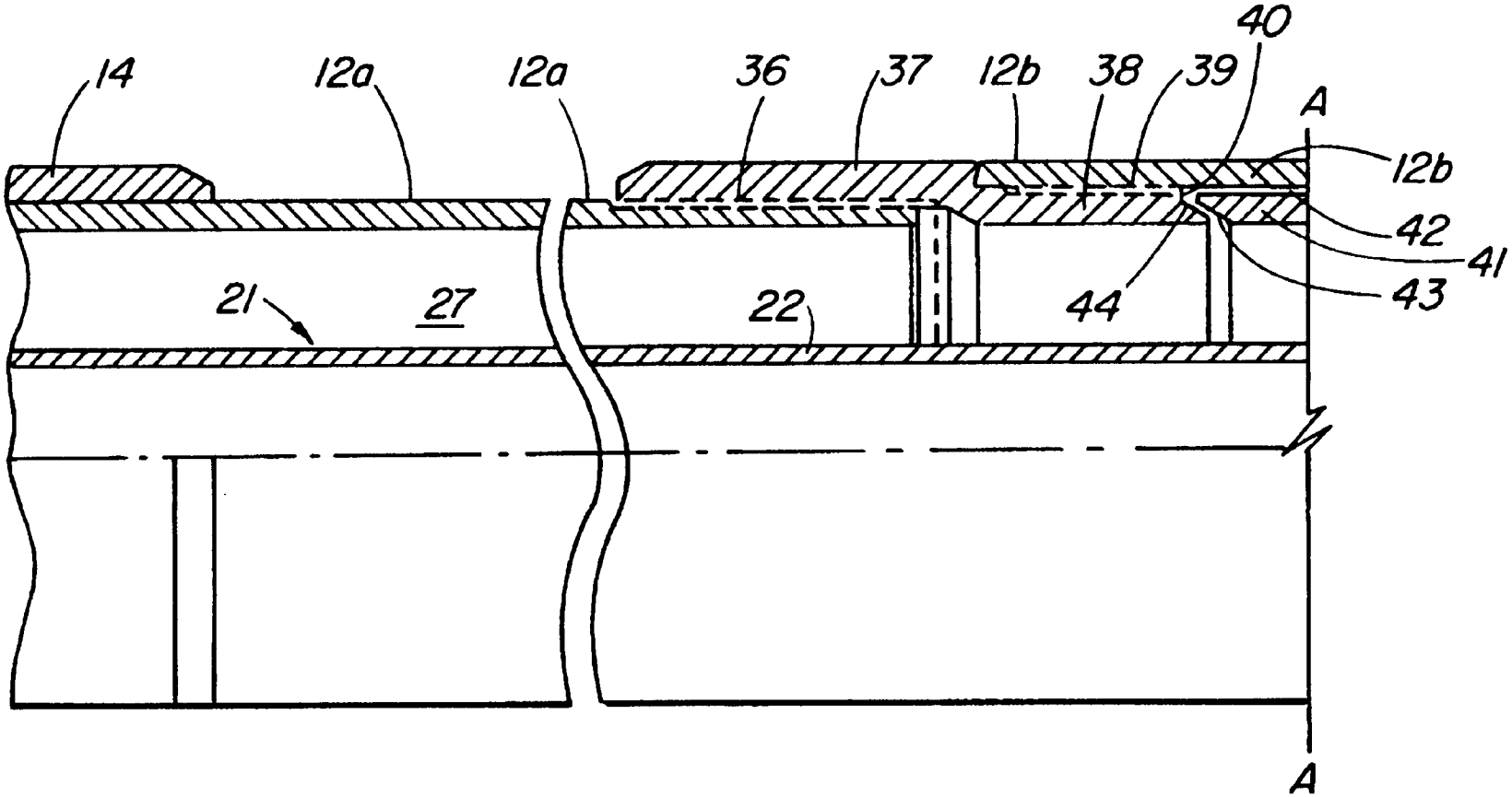
FIGS. 2A, 2B, 2C and 2D together show a length of casing between two inflatable packers and equipped with a relief valve means according to one embodiment of the present invention.

Referring now to FIGS. 2A through 2D, which should be viewed as being disposed end-to-end with the portion shown in FIG. 2A as being the upper end. There is generally shown at 35 in FIG. 2C, a relief valve means 35 which functions to relieve pressure in the annular space 17 when the casing is installed in a bore hole and a related inflatable packer is deployed. The embodiment of the invention illustrated in FIGS. 2A through 2D is in a form which permits installation of the relief valve system at a selected location in combination with inflatable packers of current design.

Figure 2B:
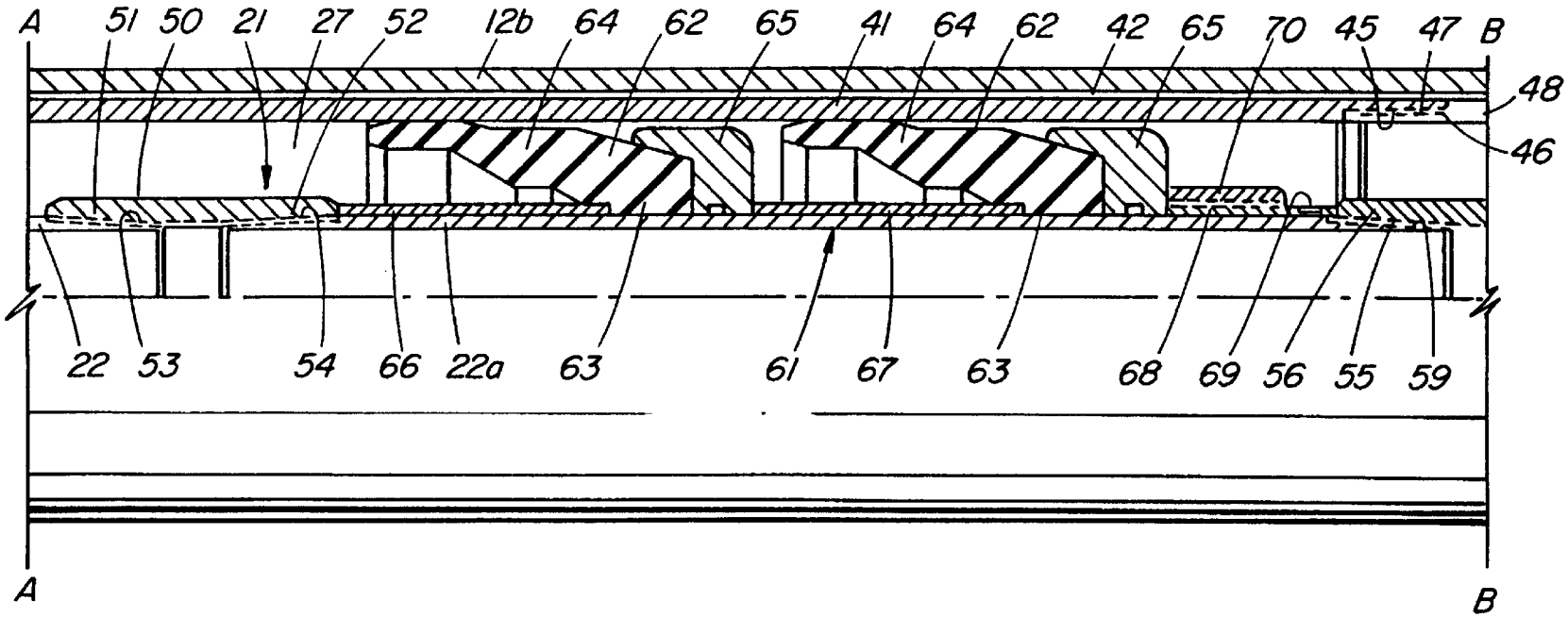
Figure 2C:
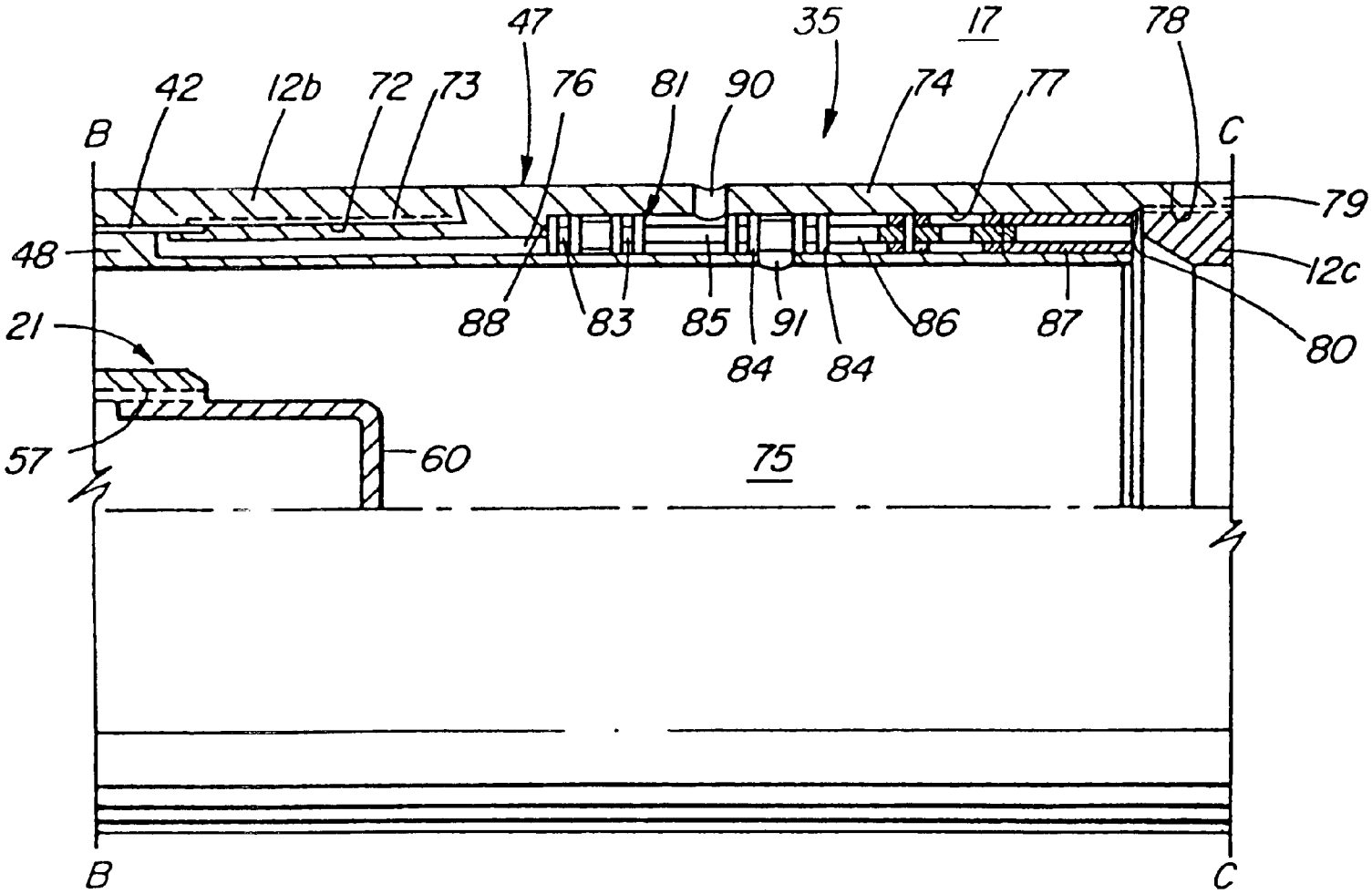

FIG. 2A shows a portion of the casing member designated 12*a* above the relief valve means, the casing 12*a* being part of an inflatable packer assembly providing the intermediate packer 14 provided for future deployment as described above. The part surrounding the casing member 12*a* and being designated 14 is a lower metal collar disposed about the lower end of the resilient sleeve of the packer. The relief valve means 35 is disposed in the casing string below the intermediate packer 14, and above the earlier inflatable lower packer shown at 15 in FIG. 2D. The upper inflatable packer 13 described above would be located in the casing string above the packer 14, and is not shown, of course in FIGS. 2A through 2D. As shown in FIG. 2C the relief valve means is shown in a condition prior to the deployment of packer 14. As shown the annular space 17 surrounding the casing would be isolated from the remainder of the bore hole by way of the inflation of lower packer 15 (FIG. 2D) and upper packer 13 (not shown). As shown by the reference character 21 in FIGS. 2A to 2C, the setting tool is illustrated as being in place for deployment of intermediate packer 14.

As illustrated in FIG. 2A, the lower end of casing member 12*a* is externally threaded at 36, and internal threads at the upper end of a sub connector 37 are threaded thereon. The sub connector 37 has a lower portion 38 having an internal diameter the same as casing member 12*a* and an external threaded surface 39 of reduced diameter. The lower end surface 44 of the lower portion 38 is bevelled upwardly and outwardly to the threaded surface 39. A casing member 12*b*, which is of the same outer diameter as the outer surface of the sub connector 39 has internal threads at its upper end mating with threads 39 of the sub connector 37. The internal surface of casing member 12*b* is of greater diameter than that of casing 12*a*. Located within casing member 12*b* is a tubular member 41 which has an internal diameter corresponding to that of the lower portion 38 of the sub connector 37 and an external diameter smaller than that of the internal diameter of the casing member 12*b*. Thus, a passageway 42 is defined between casing member 12*b* and tubular member 41. An upper end surface 43 of the tubular member 41. slants upwardly and outwardly from the internal surface of the tubular member. The bevelled upper end surface 43 is spaced from the bevelled lower end surface 44 of the sub connector so as to provide an entrance passage 40 which slopes upwardly and outwardly relative to the passageway 42. As shown this entrance passage is formed between the spaced surfaces 44 and 43 which are of frusto conical shape. A lower end of the internal casing or tubular member 41 is internally threaded at 45 and is threaded onto an externally threaded part 46 of an upwardly projecting portion 48 of a valve housing member 47. (FIGS. 2B & 2C)

The setting tool 21 includes at the bottom of tubular member 22 a connecting collar 50, which includes internal threads 51 and 52 the former of which receives a lower external threaded portion 53 of tubular member 22. A lower tubular portion 22*a* has a threaded portion 54 at its upper end threaded into internal threads 52 of the collar 50. A lower end of tubular member 22*a* has an external threaded section 55 which is threaded into an upper internal threaded end 57 of collar 56. Into a lower internal threaded end 57 of the collar 55 is threaded a closure plug, commonly termed a bull plug 60 (FIG. 2C). While the bull plug 60 is shown as a member which completely encloses the lower end of the tubular member 22, this plug may be in the form of a spring loaded ball-type check valve which allows flow from within the casing below a lower packer cup assembly 61 into the tubular member 22 but prevents pressurized fluid from within the tubular member 22 getting into the casing.

While the drawings only illustrate the lower packer cup assembly 61 (FIG. 2B) carried by the setting tool 21, there is provided on the setting tool an upper packer cup assembly which is the same as assembly 61 but inverted. The upper and lower packer cup assemblies isolate the zone 27 therebetween in the annular space between the tubular member 22 and the casing members surrounding the setting tool. The zone 27 can be pressurized by way of a port 26 (not shown in FIGS. 2A–2D) to inflate the intermediate packer 14. As is clear from FIG. 2A the pressurized fluid in zone 27 is in communication with entrance passage 40 and thus passageway 42.

The packer cup assembly 61 includes a pair of like packer cups 62 formed of resilient material. Each cup 62 has a central passage 63 of a diameter to receive tubular member 22*a* and a flared skirt portion 64 providing an extreme flange which engages the interior of tubular member 41. Provided below each cup and in engagement with the base of the cup is a cup-shaped thimble 65 of rigid material. Extending between collar 50 and the interior of the uppermost cup 62 is a rigid sleeve 66 and between the uppermost thimble 65 and the interior of the lowermost cup is a second sleeve 67. A third sleeve 68 is disposed between the lower most thimble 65 and the collar 56. The sleeves 66, 67 and 68 have an internal diameter for close reception over the exterior of tubular member 22*a*, and the lowermost sleeve 68 is affixed to the tubular member 22 by a set screw 69. A spacer 70 is threaded on the exterior of sleeve 68 to allow for adjustment and tightening of the packer cup assembly. As shown, the packer cups 62,62 of the lower packer assembly are oriented so that they open upwardly. Thus, as the pressure of the fluid within the zone 27 is increased, the flange of the outer extremity of the flared skirt portion 64 of the packer cup is forced more tightly against the interior of the surrounded casing member.

An external surface of the upwardly projecting portion 48 is of the same diameter as the external surface of the tubular member 41, so that the passageway 42 continues to the mating threads 72 and 73 (FIG. 2C). The upwardly projecting portion 48 is provided with a longitudinally extending bore 76 which has a radial portion communicating with the passageway 42. A lower end of bore 76 communicates with a larger bore 77 in the valve housing member 47. The lowermost end of the housing member 47 is provided with an internally threaded portion 78 which receives an externally threaded upper end 79 of a casing member 12*c*. Because of the overall wall thickness of the tubular member which forms the valve housing member 47 is greater, a radial shoulder 80 is provided at the upper end of the internally threaded portion 78. The larger bore 77 extends longitudinally upward from the shoulder 80 (FIG. 2C). The larger bore contains an actuating means in the form of a movable spool valve assembly 81.

As previously described a passageway 42 extends downwardly between casing member 12*b* and inner tubular member 41 from the entrance passage 44 which is in communication with internal zone 27, and the lower end of tubular member 41 is threadably received on an externally threaded portion 46 of valve housing member 47 (FIG. 2B). The valve housing member has an external diameter which is the same as that of casing member 12*b* (FIG. 2C). The lower end of casing member 12*b* is internally threaded at 72, and the valve housing member 47 has an externally threaded portion 73 intermediate externally threaded portion 46 and its outer surface 74, the threaded portion 73 being of greater diameter than that of the threaded portion 46. It is apparent that the internal surface of the housing member 47, which is of the same diameter as the tubular member 41, forms the internal surface of the overall casing string at its location, and the zone 75 defined therein is not subject to the pressurized fluid within zone 27 as zone 75 is below the lower packer cup assembly 61.

Figure 2D:
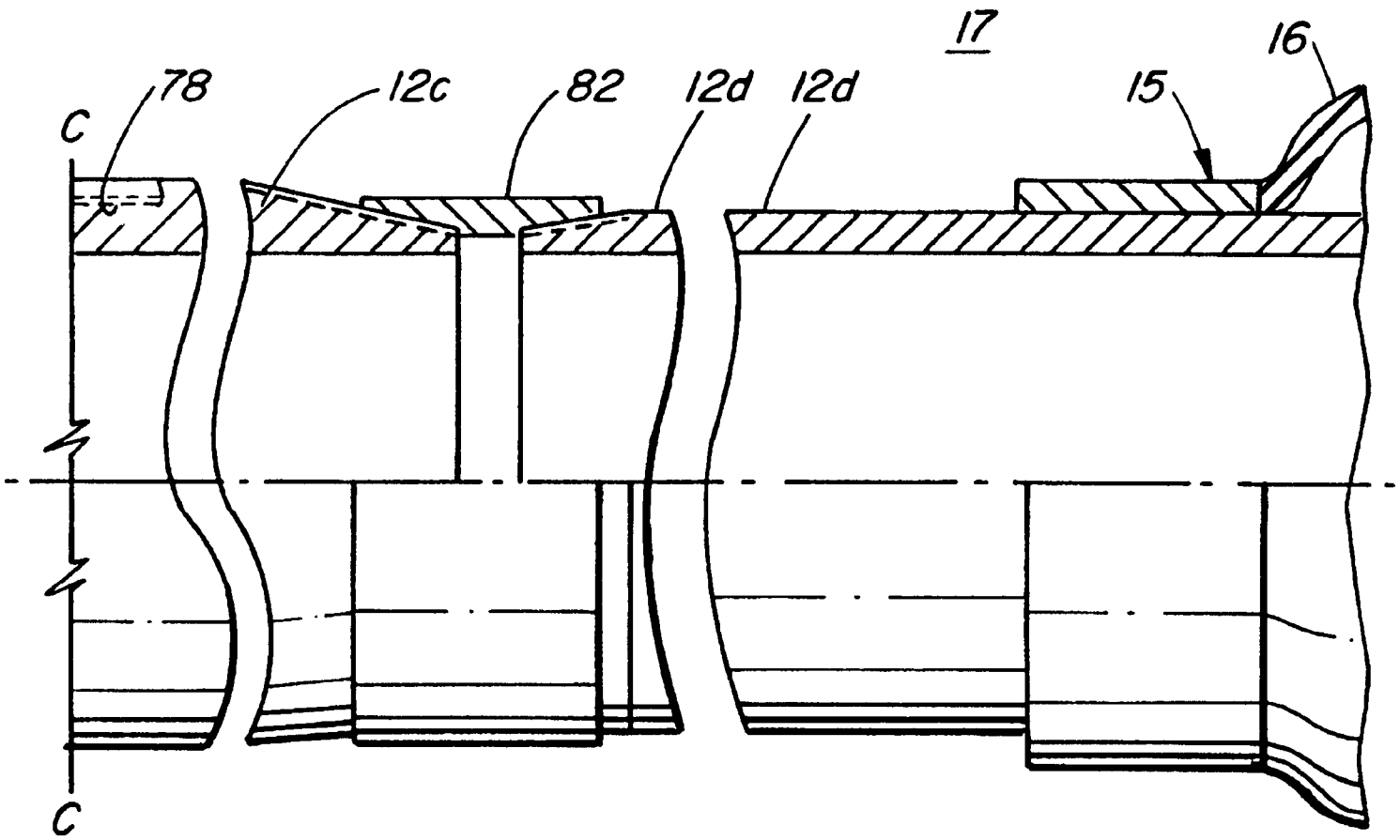

As is shown in FIG. 2D, the casing member 12*c* is connected at its lower threaded end to an internally threaded collar 82 which also receives the upper end of a lower casing member 12*d*. Depending on the separation required between inflatable packers 14 and 15, additional lengths of casing members may be provided between casing members 12*c* and 12*d*. The casing 12 has incorporated therewith the lower packer 15, the resilient tubular member 16 of which is depicted in a deployed condition so that the overall zone 17 about the casing and between this lower packer 15 and upper packer 13 is isolated from the remainder of the bore hole both above upper packer 13 and below the lower packer 15.

Returning now to the structure of the relief valve assembly 35 as shown in FIG. 2C, an upper or head end of the assembly 81 is formed by a pair of spaced, grooved lands 83. An intermediate part of the spool valve assembly 81 is formed by a second pair of spaced, grooved lands 84. The pairs of lands 83 and 84 are spaced in the longitudinal direction of the assembly and are joined by an integral spindle 85 of small diameter. Projecting from the rear end of the spool assembly is a stem 86, the outer end of which is received in a tubular sleeve 87 located in the outer end of bore 77. The extreme inner end of the bore which is in fluid communication with the passage or bore 76 forms a valve control chamber 88. Extending between the bore 77 and the outer surface 74 of valve housing member 47 is a passage or port 90. This port is disposed relative to the length of the bore 77 so that it intersects the bore 77 as a location between the two pairs of lands 83 and 84 when the spool valve assembly 81 is in its inactive or initial position as shown in FIG. 2C. Extending between the bore 77 and the interior of the valve housing member 47 is a passage or port 91. This port is disposed relative to the length of the bore 77 so that it intersects the bore 77 between the pair of lands 84 when the spool valve assembly 81 is in the shown initial position.

Figure 3A:
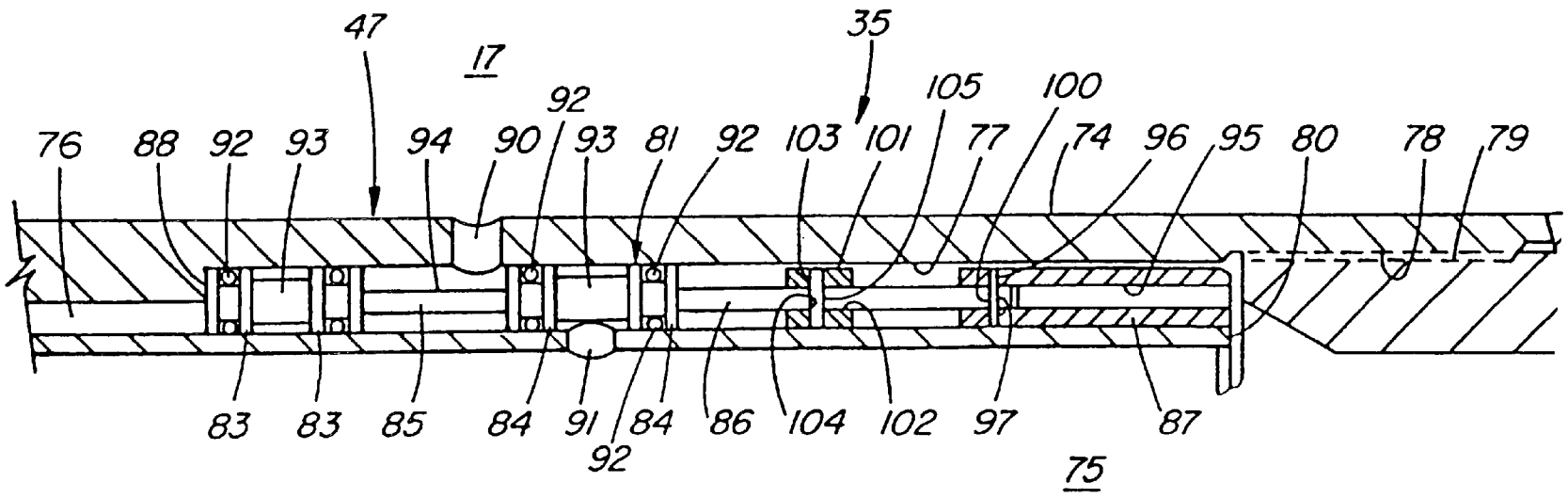
FIGS. 3A, 3B and 3C are enlarged sectional views showing the relief valve assembly of the present invention in more detail in three different positions.
Figure 3B:
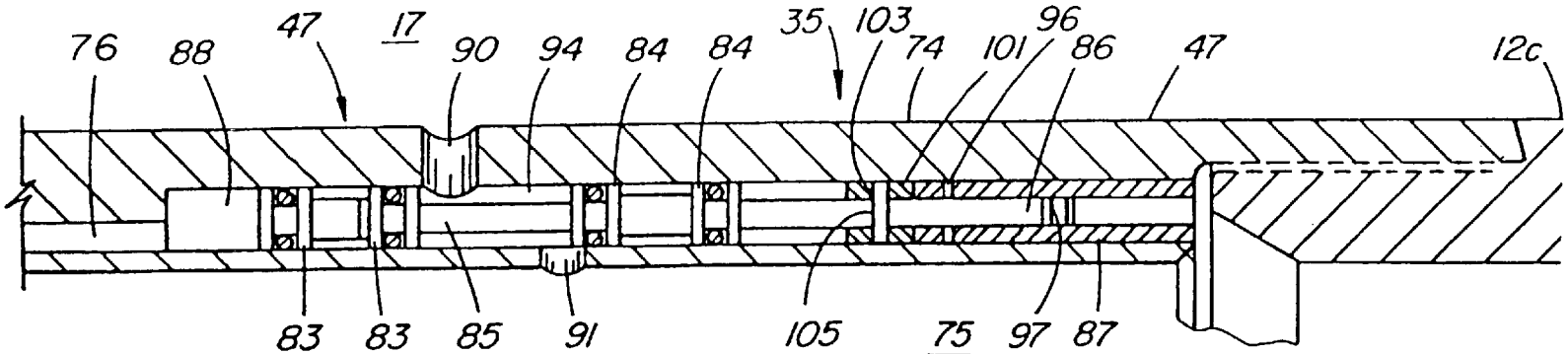

Referring now to FIGS. 3A to 3B which show the relief valve means 35 in more detail, it can be seen that the two pairs of lands 83 and 84 are of similar configurations. They are of a diameter slightly less than the inside diameter of the bore 77 so that the spool valve assembly is slidably lengthwise therein. Each land is provided with an annular groove which receives an O-ring 92 so as to provide a seal with the interior of the bore. The two lands in each pair are separated by an integral short stubby spindle 93. Flow of fluid between the valve control chamber 88 and annular chamber 94 which surrounds the spindle 85 is prevented by the O-rings of the pair of lands 83. Flow between chamber 94 and the rear end of the bore 77 is prevented by the O-rings 92 of the pair of lands 84. Flow of fluid between port 91 and the chamber 94 is prevented by the O-ring 92 to the left of port 91 and flow between port 91 and the rear end of the bore 77 is prevented by the O-ring 92 to the right of port 91. In the initial position shown in FIG. 3A, flow is normally prevented from port 90 through chamber 94 to the port 91 by the O-ring to the left of port 91.

The sleeve 87 is fixed within the bottom or rear end of bore 77 against movement to the right as shown in FIG. 3A, and this sleeve provides a longitudinal bore 95 of a diameter slightly larger than the outer diameter of the stem 86 so that the stem can move freely into the bore 95. Adjacent the top or front end of the sleeve 87 is a transverse bore 96 which aligns with a transverse bore 97 through the stem 86 near its outer free end. Received in the transverse bores 96 and 97 is a shear pin 100 of a predetermined shear strength. The shear pin 100 normally holds the spool valve assembly 81 in its initial extreme left hand position as seen in FIG. 3A. In this position there is no fluid communication between ports 90 and 91 as previously explained, and thus there can be no flow of fluid from the annular space 17, regardless of its pressure, through to the zone 75 within the casing string. Moreover, regardless of the expansion of pressure within control chamber 88 via entrance passage 44, passage way 42 and bore 75, provided the pressure is below a predetermined amount as determined by the selection of the shear pin 100, the spool valve assembly 81 will not move from its initial position.

An annular shaped collar 101 which has a central bore 102 is adapted to slidably receive the stem 86 and is positioned between the pair of lands 84 and the upper or front end of the sleeve 87. The collar has a transverse bore 103 which can align with a second transverse bore 104 in the stem 86 midway between the first transverse bore 97 and the pair of lands 84. A second shear pin 105 of a predetermined shear strength which is greater than that of shear pin 100 is received in bores 103 and 104 to prevent movement of the stem 86 through the collar 101.

When a decision has been made to deploy the intermediate packer 14, the setting tool 21 is inserted into the casing string from the well head until it reaches to the position shown in FIGS. 2A through 2C. From the ground surface at the well head, the fluid pressure within the tubular member 22 is increased to a pressure which is known to be required to start inflation of the intermediate packer 14. The fluid entrapped in the annular space between already inflated packers 13 and 15 starts to experience an increase in pressure due to the deployment of the intermediate packer. However, as the pressure of the fluid within zone 27 in the case string rises, the pressure within the valve control chamber also rises due to the communication existing through entrance passage 44, passageway 42 and bore 76. The force acting on the head end of the spool valve assembly 81 within central chamber 88 thus reaches a level on commencement of the deployment of the packer 14 to cause shearing of pin 100. This allows the stem 86 to slide downwardly in bore 95 of sleeve 87 toward the rear of the relief valve means until collar 101 engages the front end of the sleeve 87 at which point the spool valve assembly is positioned in a second or open position as shown in FIG. 3B.

When the spool valve assembly has been moved to its activated or open position as illustrated in FIG. 3B, it can be seen that the port 90 remains in communication with chamber 94 and thus serves as an inlet means from the zone 17 in the annular space about the casing and in which the fluid pressure is rising due to the initial deployment of intermediate packer 14. Also because the spool valve assembly 81 has moved, the port 91 is also placed in communication with the chamber 94 so that it functions as an outlet means into the interior of the valve housing member 47, i.e. into the zone 75 within the casing string below the setting tool 21. This is accomplished because the length of the spindle 85 between the two pairs of lands 83 and 84 is at least equal to the outside distance between the ports 91 and 92. Accordingly, the fluid being squeezed in the zone 17 is allowed to be displaced to within the casing string.

It is undesirable, of course, that the fluid in the annular space about the casing string remain in communication with the fluid within the casing string after the intermediate packer has been inflated. As the pressure within the zone 27 builds upon completion of the deployment of intermediate packer 14, the pressure within control chamber 88 of the relief valve means 35 also increases. As the pressure reaches a predetermined value, the force provided by the pressure acting against the head end of the spool valve assembly in control chamber 88 reaches a predetermined amount to cause shearing of the shear pin 105. Accordingly, the stem is allowed to slide further rearwardly through the collar 101 and into sleeve 87, eventually reaching a third or final position as shown in FIG. 3C.

Figure 3C:
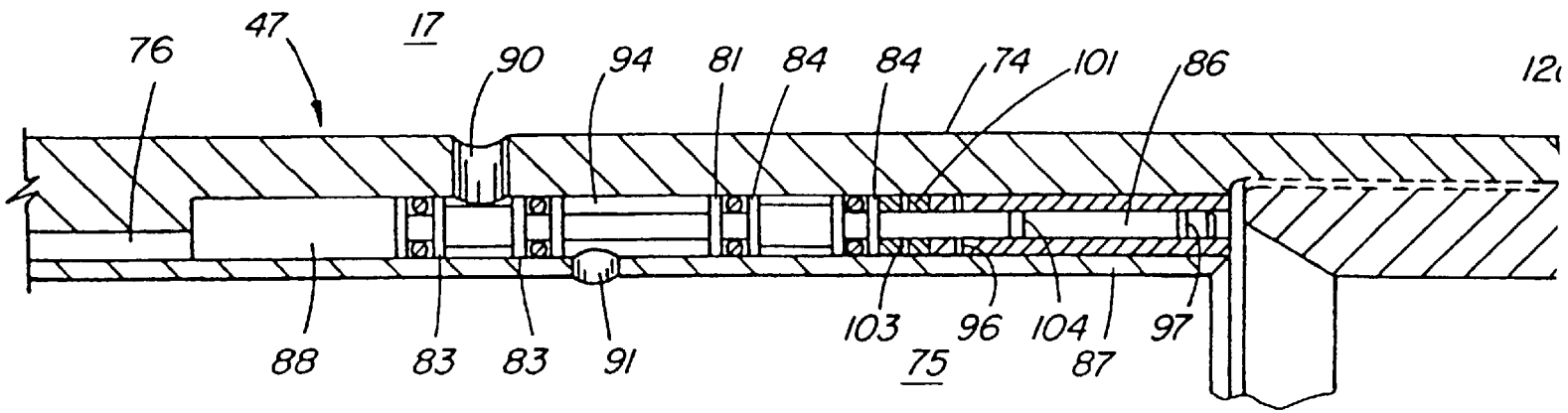

In the final position of the spool valve assembly 81 as shown in FIG. 3C, the collar 101 remains in engagement with the upper or front end of the fixed sleeve 87, and the rearmost land of the pair of lands 84 is in engagement with the upper or front end of the collar 101. The lands of the first pair of lands 83 are positioned in relation to the length of the spool valve assembly so that this final position of the spool valve assembly represents another closed position of the relief valve means 35. In the final closed position, port 91 remains in communication with the chamber 94, but the port 90 is now in communication with the space between the pair of lands 83 so that the second land from the head end of the spool valve assembly prevents flow of fluid from the port 90 to the chamber 94. In this final position, future actuation of the relief valve means cannot occur as any future increase in the pressure communication with chamber 85 does not move the valve spindle assembly out of its final position.

It is to be noted that the configuration of the entrance passage 40 requires at least a partial reversal of flow of fluid from its downward travel in the casing to enter passageway 41 on its travel to fill valve control chamber 88 as the valve spool assembly is first moved to its open position and then eventually to its final position. This flow travel at the entrance helps avoid the inflow of solid particles into the passageway which might otherwise impede flow to the valve control chamber 88.

In the embodiment of the invention shown in FIGS. 2 and 3 it can be appreciated that the relief system provided thereby can be installed at any location of a casing string in relation to a packer with which the system is to be associated. At its upper end the sub connection 37 may be attached to the external threaded end of a casing member which is not directly a part of a packer assembly 14 as illustrated above. Also at the lower end the casing member 12*c* need not be connected to a casing member 12*d* which in turn forms part of the lower packer assembly 15 as illustrated in FIG. 2D. The locating of the relief valve means 35 may be varied to suit a particular condition. For example, if the upper packer 13 is located relatively close to the bottom of a bore hole, the pressure relief means may be provided in association packer 14 located between the packer 3 and the bottom of the hole and may be provided to relieve pressure from the annular space about the casing string as packer 14 is deployed near the bottom of the drill hole.

Figure 4A:
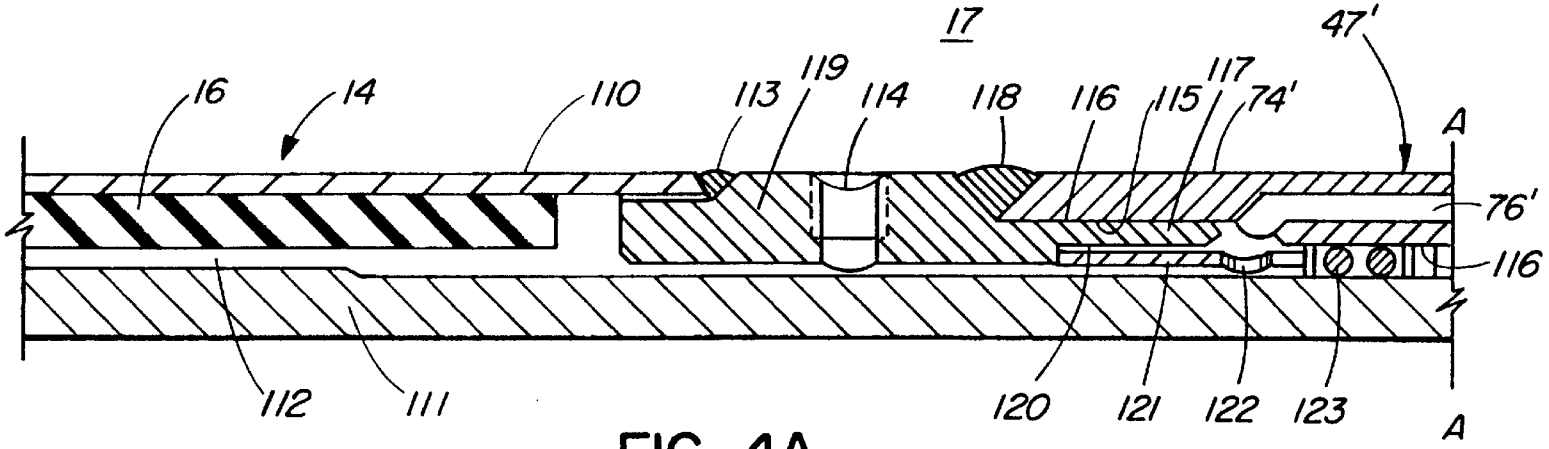
FIGS. 4A, 4B and 4C are sectional views which together show an alternative embodiment of the invention wherein the relief valve means is integrally formed with an inflatable packer assembly.
Figure 4B:
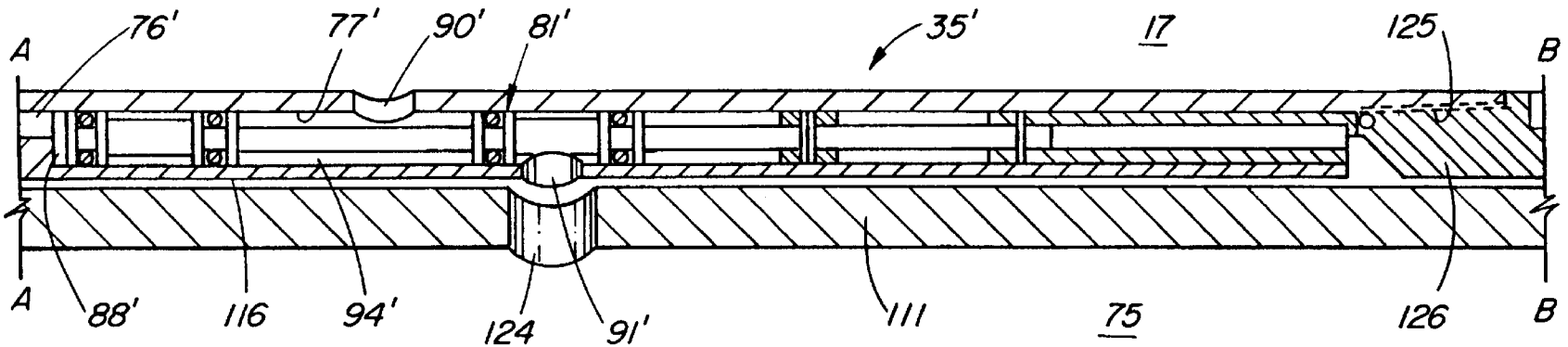
Figure 4C:
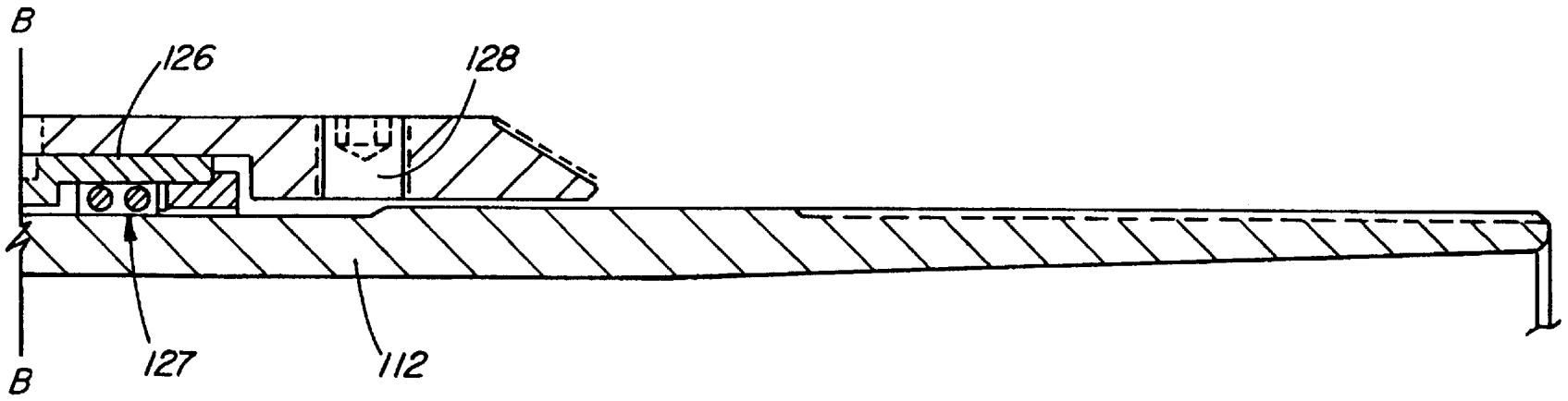

The alternative embodiment of the relief valve system shown in FIG. 4A to 4C is incorporated more integrally with a packer. Again FIG. 4A, 4B and 4C are to be considered as a continuous length with FIG. 4A representing an upper portion of the system. A lower end of intermediate packer is shown at 14. This includes the usual resilient sleeve member 16, the lower end of which is contained within a metal band 110. The packer is disposed about an inner elongated metal tubular member 111. An annular spacing between the interior of the resilient sleeve member 16 and the outer surface of the tubular member 111 defines a passage 112 which communicates with the pressurized fluid admitted to the interior of the resilient sleeve for bringing about its inflation. The metal band 110 is affixed at its lower end to a collar 119 by way of a weld 113, the collar being fixed against movement relative to the tubular member 111 by way of a set screw means 114. The collar 119 has an internal diameter which is greater than the outer diameter of the tubular member 111 so that the passage 112 can continue thereunder.

A valve housing member 47' which has an external cylindrical surface 74' is provided at its upper end with an internal surface 115 of a diameter greater than its internal cylindrical surface 116. The upper end of valve housing member 47' receives a reduced lower portion 117 of the collar 119 and is affixed thereto by a weld 118. The lower end of collar 119 is also formed with an interior surface 120 of greater diameter than the internal diameter of the remainder of the collar. Received in the lower end of increased diameter is a sleeve 121 which is provided with an opening 122. The internal surface of the sleeve 121 is of greater diameter than the external diameter of the tubular member 111 so that passage 112 continues downwardly to the opening 122 of the sleeve 121. Located between the upper end of the valve housing member 47' and the tubular member 111 just below sleeve 121 is a seal means 123. An upper end of a bore 76' in the valve housing member 471 is in communication with the opening 122 of the sleeve 121. Because the bore 76' opens into the bore 77' which contains the spool valve assembly 81', the fluid supplied to deploy the packer 14 is in communication with a valve control chamber 88' via the passage 112 and bore 76'. The structure of the overall valve relief means 35' is substantially the same as that described in relation to the earlier embodiment. The valve housing member 47' is provided with a port 90' which places the zone 17 in the annular space about the casing in communication with the annular chamber 94' when the spool valve assembly is in its initial position. The valve housing member 47' also has a port 91' position to function as an outlet means when the spool valve assembly is actuated to its second or open condition. However, as the interior 116 of the valve housing member is not directly exposed to the interior zone 75 of the casing string, the tubular member 111 is provided with an opening 124 so that the fluid which flows through annular chamber 94' from the exterior zone 17 is free to continue through port 91' and then through opening 124 into the interior of the casing string. The relief valve means 35' otherwise functions in the same manner as described above.

It should be noted that although a setting tool is not shown in FIG. 4A through 47, it would normally be inserted for inflating packer 14 so that the lower packer cup assembly would be disposed above the outlet opening 124. Thus, the pressurized fluid applied to deploy the packer 14 and to actuate the relief valve means 35' does not occupy the zone 75.

The lower end of the valve housing member is internally threaded as shown at 125 (FIG. 2B) and threadingly receives the upper end of an externally threaded seal block assembly 126 which includes a seal means 127 engaging the external surface of tubular member 112. The seal block assembly is affixed to the tubular member by way of a set screw 128. This lower end of tubular member 112 is externally threaded in order that it can be connected to the next lower casing member in the string.

It can be readily seen, therefore, that with the embodiment of FIGS. 4A through 4C the relief valve system of the present invention can be shipped and installed as an integral unit including the packer in association with which it functions to automatically bleed the fluid entrapped in the annular space in the well in the vicinity of the packer as it is deployed. Such an arrangement is convenient for handling and significantly reduces assembly time at the well head.

While two embodiments of the invention have been illustrated, other variations of the invention will be apparent to those skilled in the art without departing from the spirit of the invention as defined in the appending claims.

What is claimed is:

1. A method of inflating a packer means disposed about a casing in an annular space between an exterior of said casing and a wall of a well bore containing said casing, said packer means having valve means responsive to an increase in fluid pressure of a pressurized fluid supplied thereto for admitting the pressurized fluid to an interior of said packer means to thereby deploy said packer means, the method including the steps of:

supplying a supply fluid at a first predetermined pressure to said packer means for initially deploying said packer means, providing said casing, prior to inserting of said casing into the bore, with a relief valve means in the vicinity of sa d packer means, said relief valve means having inlet means in fluid communication with said annular space and outlet means in fluid communication with an interior of said casing, said relief valve means including actuating means responsive to said first predetermined pressure of the supply fluid of said packer means for placing said inlet means in fluid communication with said cutlet means, said actuating means being further responsive to a second predetermined pressure for closing said communication between said inlet means and said outlet means, wherein said second predetermined pressure is greater than said first predetermined pressure;

whereby said actuating means of said relief valve means places said inlet means in communication with said outlet means to thereby allow bleeding of fluid within said annular space to the interior of said casing during inflation of said packer means; and characterized by varying the pressure of the fluid supplied to said packer means to said second predetermined pressure during a termination of the deploying of said packer means, whereby said actuator means of said relief valve means closes communication between the said annular space and the interior of said casing.

2. A method as defined in claim 1, wherein said casing is provided with at least three packer assemblies including an upper packer assembly and a lower packer assembly, said packer means with which said relief valve means is associated being an intermediately located packer assembly, said method further including:

the step of initially and independently deploying said upper and lower packer assemblies to isolate therebetween a zone of said annular space, said intermediately located packer assembly remaining at least for a period of time in a non-deployed state in said zone, and the step of eventually deploying the intermediately located packer assembly, characterized by said relief valve means being supplied with said supply fluid, to first move said actuating means during deployment of said intermediately located packer assembly initially from a first position to a second position for bleeding squeeze pressure developed in said zone on the deployment of said intermediately located packer assembly from said zone to said interior of said casing, and to secondly move said actuating means from the second to a third position to close communication between said zone and said interior of said casing.

3. A method as defined in claim 2, wherein said method further includes the steps of inserting a setting tool into said casing from ground level, said setting tool having packer cup assemblies for isolating an interior zone of limited length within said casing;

characterized by the step of locating said setting tool in a position to establish said interior zone for supplying the pressurized fluid to said intermediately located packer assembly and simultaneously to said relief valve said interior zone being displaced from said outlet means of said relief valve means; and controlling the increase in pressure in said interior zone from ground level.

4. A relief valve system for use in a casing positioned in a well bore, said valve system providing relief of entrapped pressurized fluid in said casing having inflatable packer means on an exterior surface of said casing for allowing effective sealing of said packer means against an interior wall of said well bore, said casing providing a sealed annular space between said exterior surface of said casing and the interior wall of said well bore on expansion of said inflatable packer means, said packer means being of the type having packer valve means for permitting the flow into said packer means of inflating fluid transmitted to said packer means at pressures controlled from ground surface, said packer valve means being responsive to an increasing pressure of said inflatable fluid to open said packer valve means and allow flow of said inflating fluid to the interior or said packer means;

characterized by the relief valve system including:

a housing defining an inlet means in fluid communication with said annular space and an outlet means in fluid communication with the interior of said casing, means defining a passage in said housing for placing said inflating fluid in communication with a control chamber in said housing, and a valve member in said housing and in an initial position closing fluid communication between said inlet means and said outlet means, said valve member being movable to an open position in response to the inflating fluid in said control chamber reaching a first predetermined pressure and thereby permitting fluid flow from said inlet means to said outlet means of said housing, said valve member being movable to a closed position in response to said inflating fluid in said control chamber reaching a second predetermined pressure greater than said first predetermined pressure and thereby closing the fluid communication between said inlet means and outlet means of said housing.

5. A relief valve system as defined in claim 4, characterized by said housing being formed by a tubular member having a cylindrical wall, a valve chamber within said cylindrical wall and containing said valve member, said control chamber being disposed at one end of said valve chamber, said valve member having a head end exposed to fluid pressure in said control chamber.

6. A relief valve system as defined in claim 5, characterized by said valve chamber being an elongated bore, and said valve member being a spool valve member adapted to shift endwise in said bore away from an initially closed position adjacent said one end to said open position on application of the inflating fluid to said first predetermined pressure in said control chamber.

7. A relief valve system as defined in claim 6, characterized by said spool valve member being shiftable from said open position to a final closed position upon application of the inflating fluid of said second predetermined pressure in said control chamber.

8. A relief valve system as defined in claim 7, characterized by said valve member including a main body portion and a stem portion projecting from said body portion at an end opposite said head end, and said bore has a restricted area defining a longitudinal opening receiving said stem portion for longitudinal movement therethrough upon movement of said valve member away from said initially closed position, said relief valve system further including first shear means associated with said stem portion and said restricted area and restricting said movement of said valve member away from said initial position until shearing of said shear means on said first predetermined pressure being reached in said control chamber.

9. A relief valve system as defined in claim 8, characterized by said first shear means being provided by, said restricted area being defined by a sleeve member affixed in said bore, said first shear means including a transverse bore in said sleeve member, a transverse bore being formed in said stem portion and aligned with the transverse bore in said sleeve member, and a shear pin of a first predetermined rating of shear being received in said transverse bores.

10. A relief valve system as defined in claim 8, characterized by;

a collar member being slidable in said bore of said valve chamber and having a central opening for slidably receiving said stem portion of said valve member, said collar member being disposed between said main body portion of said valve member and said restricted area of said bore, a second shear means associated with said collar member and said stem portion and locking said stem portion against movement through said collar until said second predetermined pressure is reached in said valve control chamber, said collar member being disposed in said locked condition when said valve member is in initial closed position a distance away from said restricted area equal to the required distance of movement of said valve member from the initial closed position to said open position whereby upon shearing of said first shear means said valve member moves to said open position and is held in said open position by engagement of said collar member with said restricted area, said valve member subsequently moving to said final closed position upon shearing of said second shear means.

11. A relief valve system as defined in claim 10, characterized by:

said second shear means including a transverse bore in said collar member and a transverse bore in said stem portion and aligned with the transverse bore in said collar member, and a shear pin of a second predetermined rating received in said transverse bores, the second predetermined rating of shear being greater than that of said first predetermined rating of shear.

12. A relief valve system as defined in claim 6, characterized by:

said spool valve member including a pair of spaced land means having disposed therebetween an annular transfer chamber, said inlet means being provided by a port means in said cylindrical wall open to an exterior surface of said cylindrical wall and to said bore, said outlet means being provided by a port means open to an interior surface of said cylindrical wall and to said bore at a location longitudinally spaced in said bore from said port means forming said inlet means, and said annular transfer chamber being of a length for placing the two port means in communication only when said valve member is in said open position.

13. A relief valve system as defined in claim 5, wherein said packer means is of the type for receiving the pressurized fluid for a zone defined interior of the casing established by a pair of packing cups of a setting tool inserted from ground level into said casing, characterized by:

said relief valve system including a casing extension means for connecting said housing to the casing on which said packer means are provided, and said outlet means of said housing being disposed beyond said zone defined interior of said casing.

14. A relief valve system as defined in claim 13 characterized by:

said casing extension including an outer casing member and an inner tubular member disposed circumferentially within the outer casing and defining a longitudinal extending passageway therebetween, means placing a delivering end of said passageway in communication with said passage of said housing, and an entrance passage placing a receiving end of said passageway in communication with said zone interior of said casing.

15. A relief valve system as defined in claim 14, characterized by:

a connecting collar threadably connected to an upper end of said casing member opposite to said housing, said collar defining an interior downwardly and inwardly bevelled surface, said tubular member having an upwardly and outwardly bevelled end opposed to and spaced from said bevelled surface of said connecting collar so as to define said entrance passage which slopes upwardly and outwardly from the interior of said tubular member and communicates with an upper end of said longitudinally extending passageway.

16. A relief valve system as defined in claim 13, wherein said packer means is of the type including an inflatable resilient sleeve encompassing an outer surface of a casing member and defining therebetween an annular space for receiving the inflating fluid; and characterized by said tubular member forming said housing including an internal cylindrical surface surrounding an external surface of said casing member at a location longitudinally spaced from said resilient sleeve, means providing a passage communication at one end with the annular space within said resilient sleeve and at the other end with said passage in said housing, said casing member within said housing having a port placing said outlet means of said housing in communication with the interior of said casing outside of the zone defined interior of said casing, said relief valve system and packer means forming an integral unit.

* * * * *

UNITED STATES PATENT AND TRADEMARK OFFICE

CERTIFICATE OF CORRECTION

PATENT NO. : 6,065,544
DATED : May 23, 2000
INVENTOR(S) : Marvin L. Holbert

It is certified that error appears in the above-identified patent and that said Letters Patent is hereby corrected as shown below:

Title page,
Assignee information should be as follows:
Item [73] Assignee, Weatherford/Lamb, Inc., Wilmington, Delaware Signed and Sealed this Fourteenth Day of May, 2002

*Attest:*

*Attesting Officer*

JAMES E. ROGAN
*Director of the United States Patent and Trademark Office*